United States Patent [19]

Komossa et al.

[11] Patent Number: 4,718,198

[45] Date of Patent: Jan. 12, 1988

[54] APPARATUS FOR GRINDING CUTTING EDGES OF KNIVES IN TOBACCO CUTTING MACHINES

[75] Inventors: Werner Komossa, Börnsen; Nikolaus Häusler, Wohltorf, both of Fed. Rep. of Germany

[73] Assignee: Hauni-Werke Körber & Co. KG., Hamburg, Fed. Rep. of Germany

[21] Appl. No.: 693,752

[22] Filed: Jan. 23, 1985

[30] Foreign Application Priority Data

Feb. 2, 1984 [DE] Fed. Rep. of Germany ..... 3403548

[51] Int. Cl.[4] ..... B24B 9/00

[52] U.S. Cl. ..... 51/33 W; 51/33 HK; 51/249

[58] Field of Search ..... 51/33 R, 33 W, 33 HK, 51/246, 247, 249, 34 R, 31, 32, 50 R; 83/174

[56] References Cited

U.S. PATENT DOCUMENTS

| | | | |
|---|---|---|---|
| 627,863 | 6/1899 | Maynard | 51/246 |
| 1,193,453 | 8/1916 | Brinkman | 51/33 W |
| 2,151,204 | 3/1939 | Hartman | 51/33 R |
| 2,762,169 | 9/1956 | Schmaus | 51/33 HK |
| 3,374,699 | 3/1968 | Schmermund | 51/249 |
| 3,979,076 | 9/1976 | Stoltzfus et al. | 51/249 |
| 4,557,074 | 12/1985 | Elsner | 51/249 |

FOREIGN PATENT DOCUMENTS 1532051 6/1964 Fed. Rep. of Germany .

*Primary Examiner*—Frederick R. Schmidt
*Assistant Examiner*—Bradley I. Vaught
*Attorney, Agent, or Firm*—Peter K. Kontler

[57] ABSTRACT

The straight of undulate cutting edges of elongated knives on the rotary knife holder in a tobacco shredding machine are ground by a driven grinding wheel, whose axis makes a small acute angle with the axis of the holder, while the grinding wheel is rocked back and forth about an axis which is parallel to the axis of the grinding wheel and is located in a second plane parallel to a first plane which is tangential to the cylindrical path of the cutting edges. If the axial length of the grinding wheel is less than the length of the cutting edges, the grinding wheel is advanced stepwise in the axial direction of the holder.

9 Claims, 5 Drawing Figures

Fig. 1
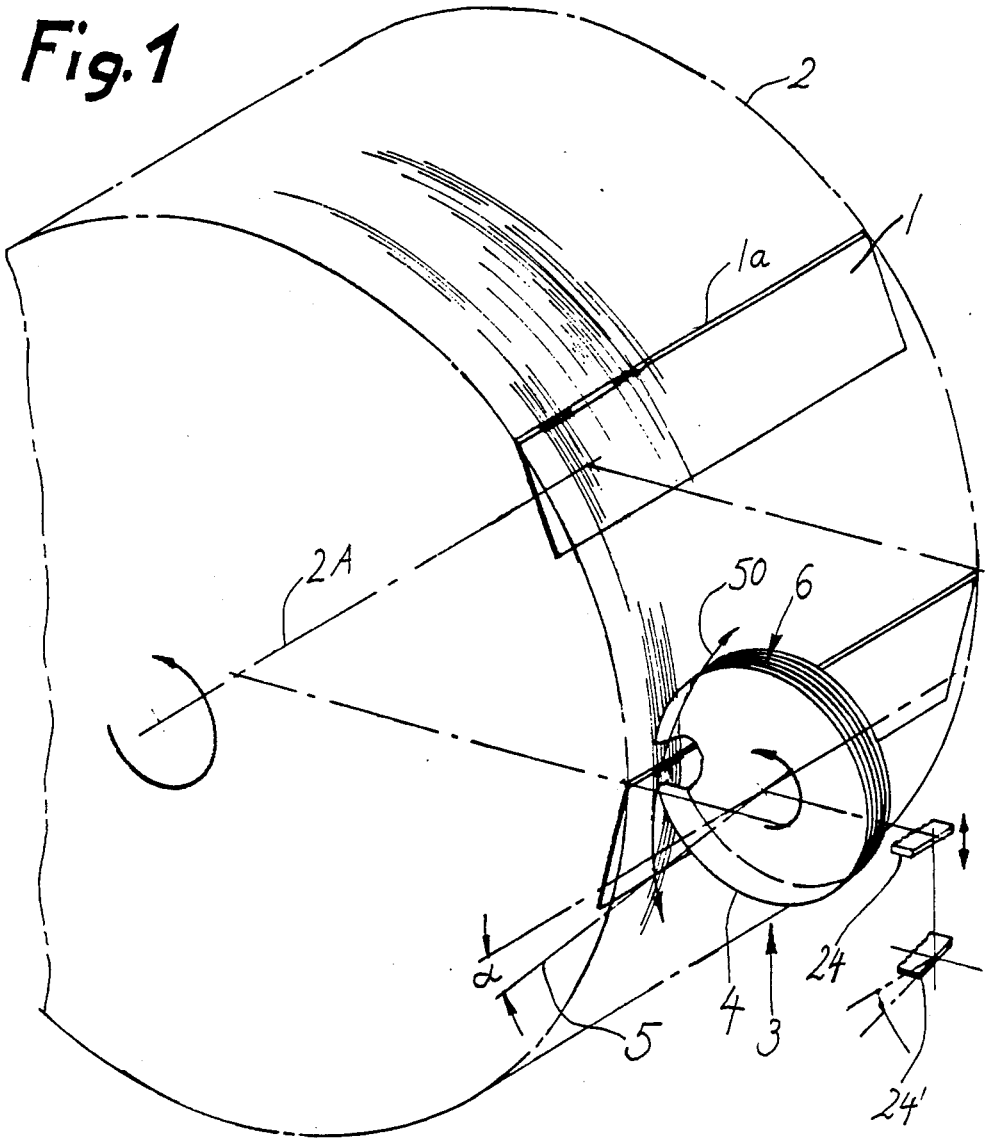
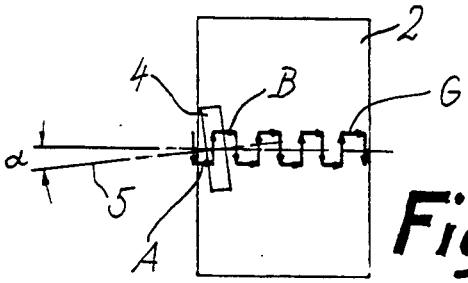
Fig. 2

102
101a
101
105
102A
α
104
103

APPARATUS FOR GRINDING CUTTING EDGES OF KNIVES IN TOBACCO CUTTING MACHINES

CROSS-REFERENCE TO RELATED APPLICATION

The apparatus which is shown in FIGS. 1–4 of the present application is similar to that shown in FIGS. 7–10 of the commonly owned copending patent application Ser. No. 630,389 filed July 13, 1984 by Uwe Elsner et al. for "Method and apparatus for grinding undulate cutting edges of knives in tobacco cutting machines" now U.S. Pat. No. 4,557,074.

BACKGROUND OF THE INVENTION

The present invention relates to apparatus for treating the knives in a tobacco cutting machine, particularly in a machine for shredding tobacco leaf laminae. More particularly, the invention relates to improvements in apparatus for grinding the cutting edges of knives in tobacco shredding and analogous tobacco cutting machines.

It is already known to shred tobacco leaf laminae with a rotary holder which supports a plurality of elongated knives having undulate cutting edges. Reference may be had to commonly owned U.S. patent application Ser. No. 561,177 filed Dec. 14, 1983 by Uwe Elsner. It is also known to grind the cutting edges of such knives by a grinding wheel having a working surface with a profile which is complementary to the outlines of undulate cutting edges. A drawback of presently known apparatus of the above outlined character is that the grinding operation is unsatisfactory because the cutting edges cannot be brought into vibration-free contact with the grinding tool. Moreover, the bearings for the knife holder and for the grinding wheel are subjected to pronounced wear.

OBJECTS AND SUMMARY OF THE INVENTION

An object of the invention is to provide a novel and improved apparatus for treating undulate or straight cutting edges of knives in a tobacco cutting or shredding machine in such a way that the cutting edges are invariably in an optimum condition for the making of satisfactory cuts.

Another object of the invention is to construct the apparatus in such a way that it can continuously or substantially continuously treat the undulate or straight cutting edge or edges of one or more orbiting knives in a tobacco cutting or shredding machine without any or without excessive vibration and without undue stressing of the bearings for the grinding wheel and knife holder.

A further object of the invention is to provide an apparatus which can be utilized for continuous or substantially continuous grinding of undulate or straight cutting edges of elongated knives in a tobacco cutting or shredding machine.

Another object of the invention is to provide the above outlined grinding apparatus with means for continuously or substantially continuously dressing the profile of the working surface of the grinding wheel.

A further object of the invention is to provide the apparatus with novel and improved means for imparting movements to the grinding wheel or wheels in a predetermined sequence so as to ensure optimum conditioning of undulate or straight cutting edges of knives in a tobacco shredding machine.

Another object of the invention is to provide the apparatus with novel and improved means for moving the grinding wheel or wheels relative to the dressing tool or tools.

The invention resides in the provision of a machine for cutting fibrous material, particularly for shredding tobacco leaf laminae and/or other parts of tobacco leaves. The machine comprises a holder (e.g., in the form of an elongated cylinder) which is rotatable about a predetermined first axis (e.g., about a substantially horizontal axis), at least one knife mounted on the holder and having an elongated straight or undulate cutting edge which moves along an endless path (normally along a cylindrical path) in response to rotation of the holder, and apparatus for sharpening the cutting edge of the knife. The apparatus comprises a conical or cylindrical grinding wheel having a (conical or cylindrical) working surface and being rotatable about a second axis making with the first axis a small acute angle of preferably less (or much less) than 15 degrees, and means for repeatedly moving the grinding wheel along a second path which extends at least substantially tangentially of the endless path so that the working surface of the grinding wheel grinds the cutting edge during each pass of the grinding wheel along the second path. The second axis is or can be located in a (second) plane which is parallel to a (first) plane extending tangentially of the endless path, and the moving means can comprise means for rocking the grinding wheel back and forth about a third axis which is parallel to the second axis and is located in the aforementioned second plane.

The axial length of the grinding wheel can be less than or it can at least approximate the axial length of the holder, and more particularly the length of the cutting edge. If the axial length of the grinding wheel is less than that of the holder, the apparatus further comprises means for advancing the grinding wheel stepwise at least substantially axially of the holder.

The working surface of the grinding wheel has or can have an undulate profile. The holder can carry a plurality of equidistant knives, as considered in the circumferential direction of the holder.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a fragmentary perspective view of a portion of a tobacco cutting machine which utilizes a grinding apparatus embodying one form of the invention;

FIG. 2 is a diagrammatic view showing the manner of advancing the grinding wheel of FIG. 1 axially of the holder and relative to the cutting edges of orbiting knives on the knife holder in the tobacco cutting machine;

DESCRIPTION OF THE PREFERRED EMBODIMENTS

Figure 3:
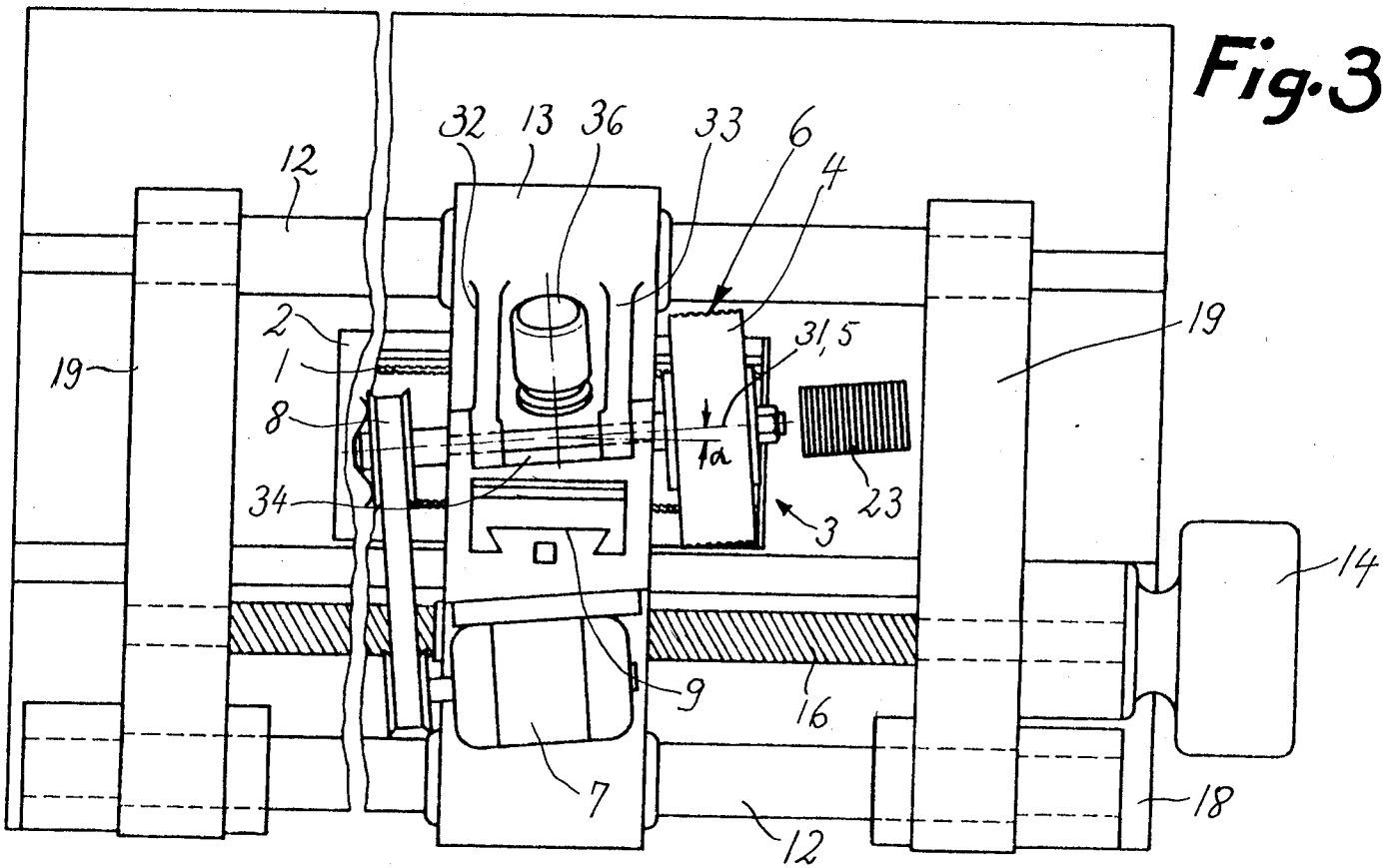
FIG. 3 is a fragmentary rear elevational view of the tobacco cutting machine which embodies the apparatus of FIGS. 1 and 2.
Figure 4:
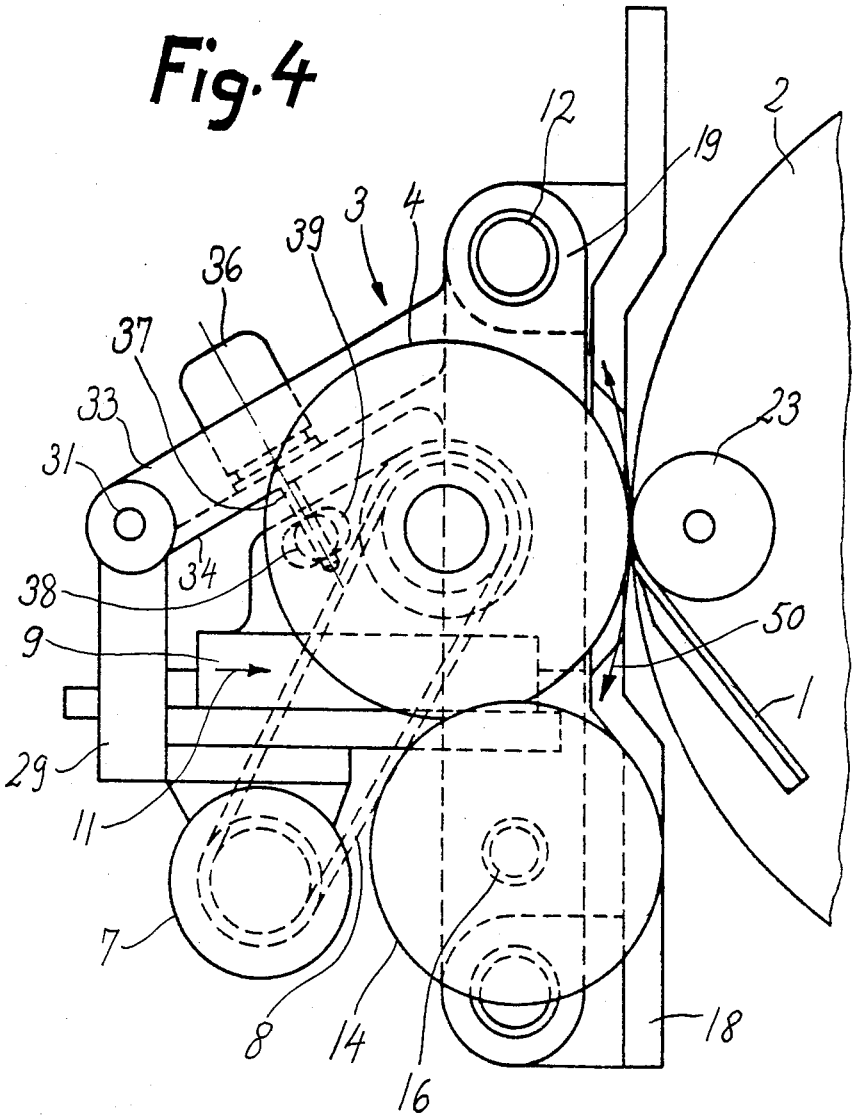
FIG. 4 is an enlarged fragmentary side elevational view of the structure which is shown in FIG. 3.

FIGS. 1 to 4 illustrate a grinding and dressing apparatus 3 which serves to grind the undulate cutting edges 1*a* of knives 1 at the periphery of a rotary holder 2 forming part of a tobacco cutting or shredding machine. As can be seen in FIG. 1, the length of the cutting edge 1*a* of each knife 1 on the holder 2 is many times the axial length of a cylindrical grinding wheel 4 which has an undulate working surface 6 whose profile is complementary to the undulate profiles of the cutting edges 1*a*. The grinding wheel 4 is located diametrically opposite that portion of the holder 2 where the cutting edges 1*a* of successive knives 1 remove shreds or otherwise configurated particles from the leader of a continuous compacted tobacco cake.

The axis 5 of the grinding wheel 4 makes a small acute angle alpha with the axis 2A of the holder 2. The plane of the axis 5 is parallel to a plane which is tangential to the holder 2 and more specifically to the endless cylindrical path for the cutting edges 1*a* of the orbiting knives 1. The undulate working surface 6 of the grinding wheel 4 contacts successive cutting edges 1*a* at the locus where the tangential plane contacts the aforementioned cylindrical path.

The grinding wheel 4 is driven by a motor 7 through the medium of an infinitely variable V-belt transmission 8. A carriage 9 is provided to support the motor 7, the transmission 8 and the grinding wheel 4 for movement substantially radially of the holder 2 in order to compensate for wear upon the surface 6 of the grinding wheel. The direction in which the carriage 9 can move the grinding wheel 4 radially of the holder 2 is indicated by the arrow 11. The means for advancing the grinding wheel 4 in parallelism with the axis 2A of the holder 2 comprises horizontal tie rods 12 which are parallel to the axis of the holder and are mounted in a frame 19. The tie rods 12 reciprocably guide a carriage 13 which supports the motor 7, transmission 8 and grinding wheel 4 and is reciprocable in parallelism with the axis 2A of the holder 2 by an advancing means including a stepping motor 14 and a horizontal feed screw 16. The frame 19 is mounted in a stationary housing 18 of the tobacco cutting machine.

The grinding wheel 4, the motor 7, the transmission 8 and the carriage 9 are mounted on a carrier 29 which is rockable about the axis of a horizontal shaft 31. The shaft 31 is supported by two spaced-apart arms 32, 33 one of which is longer than the other and which are secured to the carriage 13 and carry a plate-like platform 34 for a stepping motor 36 serving to rock the carrier 29 about the axis of the shaft 31. A feed screw 37 which is driven by the rocking motor 36 meshes with a nut 38 which is located in an elongated slot 39 of the carrier 29.

The shaft 31 determines the extent of inclination of the axis 5 with reference to the axis 2A. The axis of the shaft 31 is parallel to the axis of rotation of the grinding wheel 4, and the axis of the shaft 31 is disposed in the aforementioned plane which is parallel to the tangential plane. The axes of the shafts 31 and 2A make the angle alpha.

The grinding apparatus 3 further comprises a dressing tool 23 which is adjacent to one axial end of the holder 2 and has a profile that is complementary to the profile of the working surface 6 of the grinding wheel 4. The axial length of the dressing tool 23, as considered in the axial direction of the holder 2, at least equals the axial length of the grinding wheel 4. As shown in FIG. 1, the rotary wheel-shaped dressing tool 23 of FIGS. 3 and 4 can be replaced with a block- or plate-like dressing tool 24 having a profile which is complementary to the undulate profile of the working surface 6 of the grinding wheel 4. The plate-like dressing tool 24 can be mounted in a plane which includes the axis 5 of the grinding wheel 4, or it can be mounted at acute angle to the plane of the axis of the grinding wheel (this is shown at 24' in the lower right-hand portion of FIG. 1). The mounting of the dressing tool in a manner as shown at 24' renders it possible to effect small changes in the profile of the working surface 6 of the grinding wheel 4 if such changes are necessary.

When the grinding apparatus 3 of FIGS. 1 to 4 is in actual use, the undulate profiles of the cutting edges 1*a* of knives 1 on the holder 2 are continuously ground by the working surface 6 of the grinding wheel 4, and the working surface 6 is dressed upon completion of each of a series of successive grinding operations, namely upon completed grinding of the entire cutting edges 1*a*. The dressing operation is carried out as follows: When the grinding wheel 4 reaches its first or least grinding position (A or G, as viewed in FIG. 2), the rocking motor 36 is started to rock the carrier 29 about the inclined axis of the shaft 31 along an arcuate path and downwardly, as viewed in FIG. 4, so that the grinding wheel 4 moves substantially tangentially of the dressing tool 23 and its working surface 6 moves into engagement with the complementary profile of the dressing tool. The movements of the grinding wheel 4 under the action of the rocking motor 36 are indicated by arcuate arrows 50. When the rightmost portion of the working surface 6 (as viewed in FIG. 4) moves downwardly and below the level of the leftmost portion of the profile on the dressing tool 23, the stepping motor 14 is started so that the feed screw 16 moves the grinding wheel 4 in parallelism with the axis 2A of the holder 2 until the grinding wheel reaches the first grinding position corresponding to the position A of FIG. 2. The rocking motor 36 is thereupon operated in reverse so as to rock the grinding wheel 4 upwardly, as viewed in FIGS. 2 and 4, so that the grinding wheel moves along an arcuate path (arrows 50) and upwardly and moves tangentially into contact with the cutting edges 1*a* of the knives 1 on the holder 2 with the result that the adjacent portions of the cutting edges 1*a* are ground by the working surface 6. When the grinding wheel 4 reaches its uppermost position and is out of contact with the cutting edges 1*a*, the motor 14 is started again to advance the grinding wheel axially in parallelism with the axis 2A of the holder 2 to the next grinding position (corresponding to the position B of FIG. 2) and the motor 36 is thereupon caused to rock the carrier 29 about the inclined axis of the shaft 31 with the result that the grinding wheel 4 treats the adjacent portions of the cutting edges 1*a*. As shown in FIG. 2, grinding of the cutting edges 1*a* takes place while the grinding wheel 4 alternatingly moves upwardly or downwardly, i.e., while the carrier 29 respectively rocks clockwise and counterclockwise. The extent of axial movement of the grinding wheel 4 under the action of the motor 14 is preferably such that the freshly treated portions of the cutting edges 1*a* are partially overlapped by the working surface 6 when the grinding wheel 4 returns into tangential grinding engagement with the knives 1. Such partial overlapping ensures complete grinding of the entire cutting edges 1*a* while the grinding wheel 4 advances stepwise from the one to the other axial end of the holder 2. When the grinding wheel 4 has completed a full series of grinding operations, it is moved away from the holder 2 and is caused to perform a return stroke in parallelism with the axis 2A of the holder 2 and into register with the dressing tool 23, 24 or 24'. The dressing operation is again followed by a sequence of grinding operations in a manner as described above, i.e., the grinding wheel 4 is caused to rock along the arcuate path 50 to grind the cutting edges 1*a* first while it moves upwardly, thereupon while it moves downwardly, again while it moves upwardly, and so forth. Such upward and downward movements alternate with stepwise advances under the action of the motor 14 and feed screw 16.

Due to inclination of the axis 5 and the axis of the shaft 31 with reference to the axis 2A of the holder 2, only a portion of the grinding wheel 4 (as considered in the direction of its axis 5) comes into actual material-removing contact with the cutting edges 1*a* of consecutive knives 1 to thus ensure that the cutting edges 1*a* are subjected to a gentle grinding action which is attributable to the fact that the movement of the grinding wheel 4 has a tangential and a longitudinal axial component. The grinding action of the working surface 6 of the grinding wheel 4 involves a pull of the working surface 6 along the cutting edges 1*a*.

Figure 5:
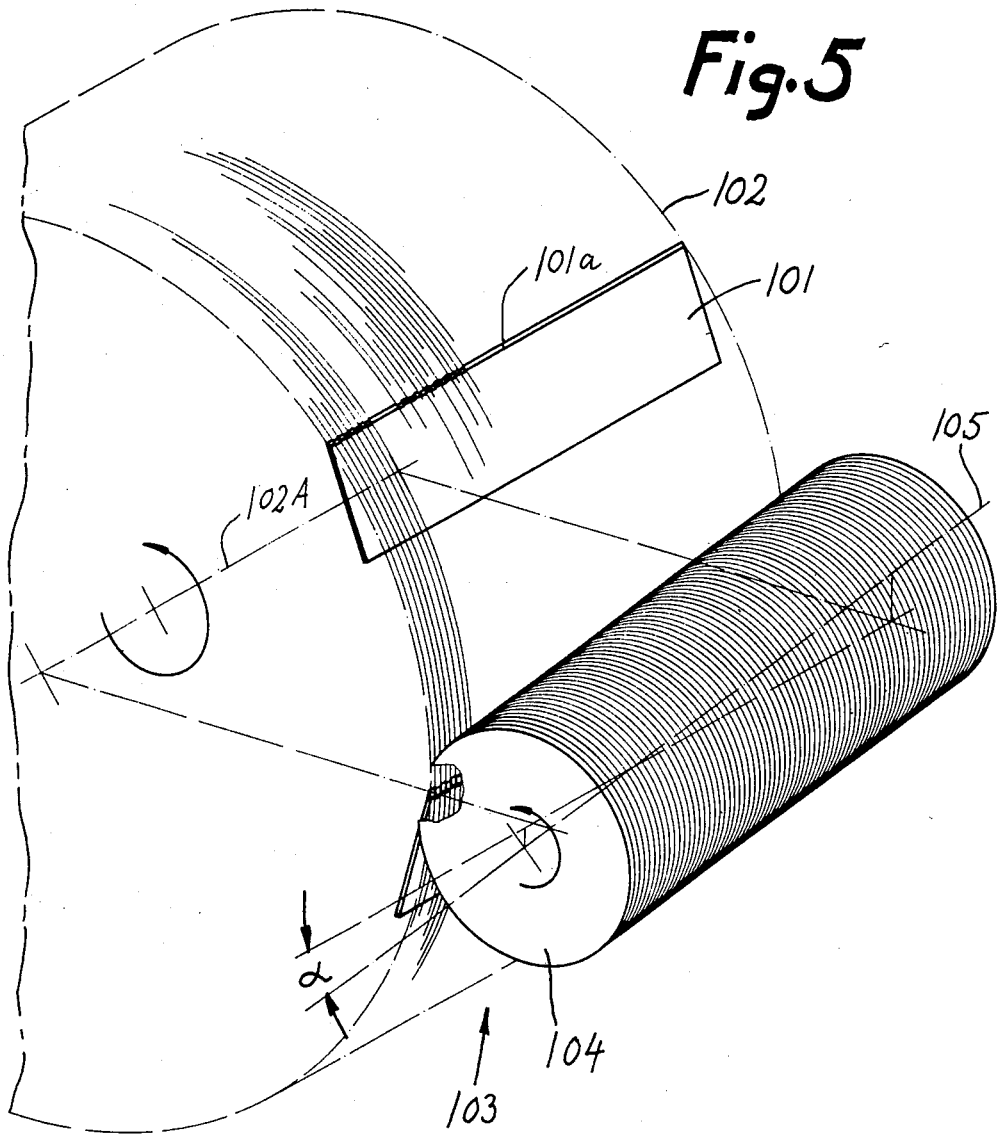
FIG. 5 is a fragmentary perspective view of a portion of a tobacco cutting machine which utilizes a modified grinding apparatus.

FIG. 5 shows a portion of a modified grinding apparatus having a grinding wheel 104 whose axial length equals or approximates the length of cutting edges 101*a* on equidistant knives 101 which are mounted on the holder 102. The axes 102A and 105 make an acute angle alpha, the same as in the embodiment of FIGS. 1–4. The utilization of a relatively long grinding wheel 104 allows for a pronounced simplification of the grinding apparatus because the means for advancing the grinding wheel 104 in the direction of the axis 102A can be omitted. Nevertheless, the inclination of the axis 105 with reference to the axis 102A ensures the establishment of a continuous and "pulling" grinding action along the full length of the cutting edges 101*a*.

The working surface of the grinding wheel 4 or 104 could have a conical or frustoconical shape. The axis of a conical or frustoconical grinding wheel is then inclined with reference to the axis 2A or 102A in a further plane at an angle which corresponds to the conicity of the grinding wheel. However, it is presently preferred to employ a cylindrical grinding wheel because this simplifies the mounting of the grinding wheel with reference to the holder 2 or 102 and/or vice versa.

It is also within the purview of the invention to replace the rocking means including the motor 36 with a means for moving the grinding wheel 4 or 104 back and forth along a straight path (rather than along an arcuate path as indicated by the arrows 50). This could be achieved by mounting the grinding wheel 4 or 104 on a carriage and by providing for the carriage a straight track tangentially of the endless cylindrical path of orbital movement of the cutting edges 1*a* or 101*a*. However, the moving means which is capable of rocking the grinding wheel 4 or 104 about the axis of the shaft 31 is preferred at this time and, moreover, if the radius of curvature of the arcuate path is relatively large, the path which is indicated by the arrows 50 is nearly tangential to the cylindrical path of orbital movement of the cutting edges 1*a* or 101*a*.

An important advantage of the improved apparatus is that only small portions of the working surface of the grinding wheel 4 or 104 (as considered in the axial direction of the grinding wheel) contact the cutting edges 1*a* or 101*a*. This ensures that the establishment of material removing contact between the grinding wheel and the cutting edges is devoid of pronounced impacts and the wear upon the bearings of the grinding wheel and/or knife holder is much less than in heretofore known apparatus. Moreover, the quality of the grinding action is highly satisfactory. This, in turn, results in a more satisfactory shredding action of the knives 1 or 101.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. In a machine for cutting fibrous material, particularly tobacco, the combination of a holder rotatable about a predetermined first axis; at least one knife mounted on said holder and having an elongated cutting edge arranged to move along an endless cylindrical first path in response to rotation of said holder; and apparatus for sharpening the cutting edge of said knife, comprising a grinding wheel having a working surface and being rotatable about a second axis making with said first axis an acute angle, said second axis being located in a plane which is parallel to a plane extending tangentially of said endless cylindrical first path and said second axis being inclined with reference to a plane including said first axis; and means for repeatedly moving said grinding wheel along a second path extening substantially tangentially of said endless cylindrical first path so that said working surface grinds the cutting edge of the knife during each pass of said grinding wheel along said second path.

2. The combination of claim 1, wherein said grinding wheel has an at least substantially cylindrical working surface.

3. The combination of claim 1, wherein said moving means includes means for rocking said grinding wheel about a third axis which is parallel to said second axis and is located in a plane which is parallel to a plane extending tangentially of said endless first path.

4. The combination of claim 1, wherein the axial length of said grinding wheel is less than the axial length of said holder, and further comprising means for advancing the grinding wheel stepwise substantially axially of said holder.

5. The combination of claim 4, wherein said moving means comprises means for rocking said grinding wheel about a third axis which is parallel to said second axis.

6. The combination of claim 1, wherein the axial length of said grinding wheel at least approximates the length of said holder.

7. The combination of claim 1, wherein said cutting edge and said working surface have undulate profiles.

8. The combination of claim 1, wherein said first and second axes make a small acute angle of less than 15 degrees.

9. The combination of claim 1, comprising a plurality of at least substantially equidistant knives on said holder

* * * * *